United States Patent [19]

Huber

[11] Patent Number: 4,458,750

[45] Date of Patent: Jul. 10, 1984

[54] INLET HEADER FLOW DISTRIBUTION

[75] Inventor: Ferdinand V. Huber, Canton, Ohio

[73] Assignee: Ecodyne Corporation, Chicago, Ill.

[21] Appl. No.: 369,522

[22] Filed: Apr. 19, 1982

[51] Int. Cl.[3] ..... F28F 9/02

[52] U.S. Cl. ..... 165/174

[58] Field of Search ..... 165/174, 110

[56] References Cited

U.S. PATENT DOCUMENTS 2,099,186 11/1937 Anderegg ..... 165/174 X 3,196,943 7/1965 Haerter ..... 165/174

3,315,738 4/1967 Jones, Jr. ..... 165/174 X 4,121,656 10/1978 Huber ..... 165/174 X

*Primary Examiner*—Sheldon J. Richter

*Attorney, Agent, or Firm*—Dressler, Goldsmith, Shore, Sutker & Milnamow, Ltd.

[57] ABSTRACT

An air cooled heat exchanger having an inlet flow distribution arrangement positioned within the inlet header to minimize maldistribution of entering fluid having a liquid-vapor mixture. The flow distribution arrangement includes a plurality of baffle means for directing the mixture entering the inlet header into defined flow channels in communication with groups of heat exchange tubes.

3 Claims, 4 Drawing Figures

INLET HEADER FLOW DISTRIBUTION

BACKGROUND OF THE INVENTION

The invention relates to heat exchangers and in particular to air cooled heat exchangers or condensers. More particularly the invention relates to an improved inlet flow distribution arrangement positioned within the condenser inlet header to minimize maldistribution of the entering liquid-vapor mixture.

Air cooled heat exchangers usually include a plurality of heat exchange tubes arranged in rows one behind the other in the direction of airflow of the cooling air. Fluid enters the condenser inlet header, which communicates with the inlet ends of the tubes, and then flows through the tubes wherein it is condensed or cooled. Fans blow cooling air across the tubes in an airflow direction generally perpendicular to the rows of tubes. The fluid is cooled and/or condensed by the cooling air to form condensate as it travels through the tubes, and the condensate is collected at the outlet ends of the tubes in a suitable manner.

It has been found that a problem exists when the fluid entering the inlet header is a mixture of liquid and vapor. In such instances, the dense liquid tends to move towards the ends of inlet header, due to its inertia, causing the tubes in communication with such ends to receive a disproportionate amount of the liquid than the other tubes. This results in the flooding of the end tubes, which reduces the available heat transfer surface. Also, the subcooled liquid also increases the stresses in the tubes due to the temperature differential between the tubes containing a disproportionate amount of subcooled liquid and the tubes containing a disproportionate amount of the vapor. Further, flooding of the end tubes with subcooled liquid may result in freezing of the condensate within such tubes under certain operating conditions.

SUMMARY OF THE INVENTION

Objectives of the invention include providing a means for minimizing the maldistribution of the liquid-vapor mixture entering the inlet header into the heat exchange tubes. This is attained by directing approximately the same proportions of vapor and liquid to various groups of tubes so as to distribute the liquid-vapor mixture throughout the tube bundle.

More specifically, in accordance with the invention, a plurality of baffle means are positioned within the inlet header so as to divide the chamber formed therein into a plurality of generally vertical flow channels. The flow channels are positioned for separating fluid entering the chamber in proportion to the number of tubes in communication with each of the channels. The channels are each in communication with groups of tubes substantially equadistant from the longitudinal center line of the condenser such that the outermost tubes on both sides are in communication with a common channel and the innermost tubes are in communication with a common channel. In accordance with the preferred form of the inventions, the channels are defined by a plurality of generally U-shaped concentric baffle plates, the open ends of which are in contact with the tube sheet of the inlet header which supports the tubes.

DESCRIPTION OF A PREFERRED EMBODIMENT

Figure 1:
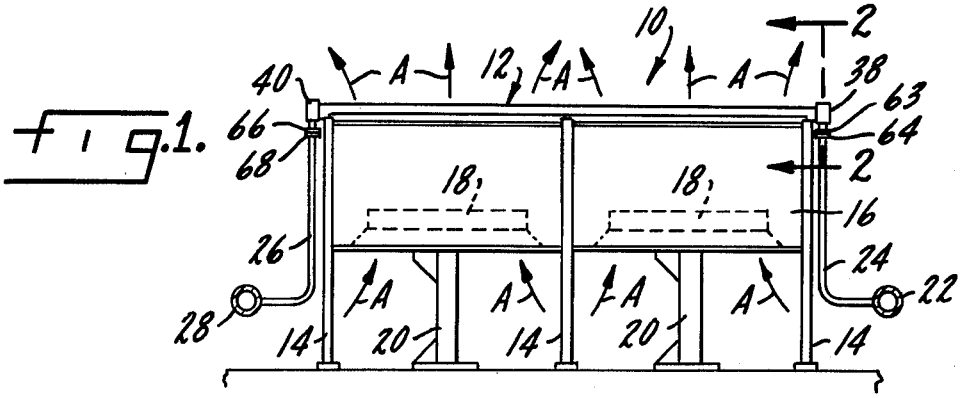
FIG. 1 is a diagrammatical side elevation showing an air cooled heat exchanger of the type which utilizes the inlet flow distribution arrangement of the present invention.

Referring to FIG. 1, an air cooled heat exchanger is indicated at 10 and includes a heat exchanger section 12 supported on frame members 14 and having side and end panels 16 mounted on the frame members 14. Fans 18 are mounted on pedestals 20 beneath condenser section 12 to blow cooling air (indicated by arrows A in FIG. 1) upward through exchanger section 12.

A fluid supply manifold 22 communicates with a source of fluid, such as the exhaust of a steam turbine, to be condensed, and pipe 24 forms an inlet for the exchanger section 12 from manifold 22. Outlet pipe 26 is connected to the opposite ends of exchanger section 12 and delivers condensate into a main manifold 28.

Different heat exchanger installations may have varying numbers of exchanger section 12 assembled together. The operation and structure of exchanger sections 12, each having the inlet flow distribution arrangement of the invention incorporated therein, are similar, accordingly, only one exchanger section 12 is described in detail.

Figure 2:
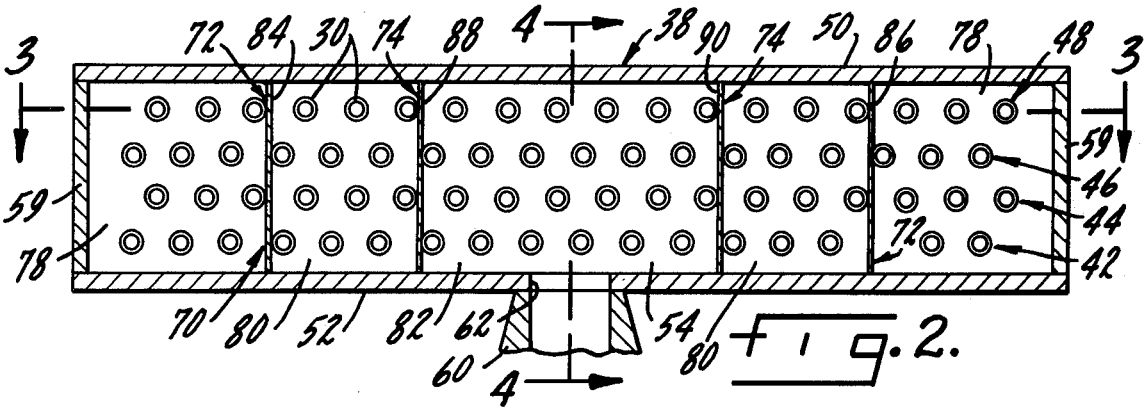
FIG. 2 is a sectional view taken along lines 2—2 in FIG. 1.

Exchanger section 12 includes a plurality of heat exchange tubes 30, preferably having helical fin portions 32 extending outward from center core or tubes portions 34. As is well known in the art, the fin portions may be brazed, soldered, grooved or tension wound to the core portions. Tubes 30 are mounted within a frame having side channels 36, an inlet header 38 and an outlet header 40. Tubes 30 are mounted parallel to each other within the frame in a plurality of rows 42, 44, 46, and 48, spaced one above the other, arranged in that order along the direction of airflow indicated by the arrow A. Tubes 30 in a particular row are preferably spaced intermediate the tubes in the adjacent rows, above and below, as shown in FIG. 2. Also, tubes 30 are assembled within the frame so as to have a slight incline from inlet header 38 to outlet header 40, such that condensate flows or drains into header 40.

Inlet header 38 may have a welded construction as shown in U.S. Pat. No. 3,582,599 of Melvin G. Yohn. Such construction includes a generally rectangular cross section formed by top and bottom walls 50 and 52, tube sheet 54, plug sheet 56 and end walls 59. The inlet ends of tubes 30 are connected in a usual manner by expanding or welding in tube sheet 54; and holes 58 in plug sheet 56 are aligned with tubes 30 to permit access into header 38 and tubes 30 for expanding or welding tubes 30 into the header and, upon removal of plugs 66, for cleaning and for removing any obstructions that may form in tubes 30. A flanged coupling 60 connected to header bottom wall 52 forms a steam inlet opening 62 for header 38. Coupling 60 has a flange 63 for connection with steam inlet pipe coupling 64 of pipe 24. Although not specifically shown, outlet header 40 may be constructed similar to header 38 having aligned holes formed respectively in a tube sheet and a plug sheet for expanding or welding the outlet ends of tubes 30 in the holes in the tubesheet and removable plugs for access through the holes in the plug sheet. The outlet opening in the bottom wall of header 40 is connected by flanged coupling 66 with coupling 68 on condensate outlet line 28.

Figure 3:
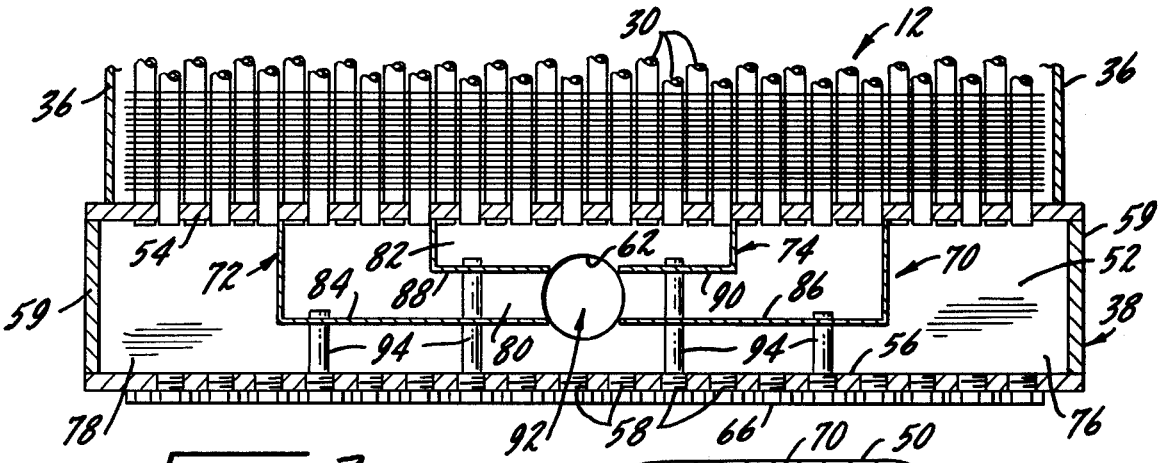
FIG. 3 is a sectional view taken along lines 3—3 in FIG. 2.
Figure 4:
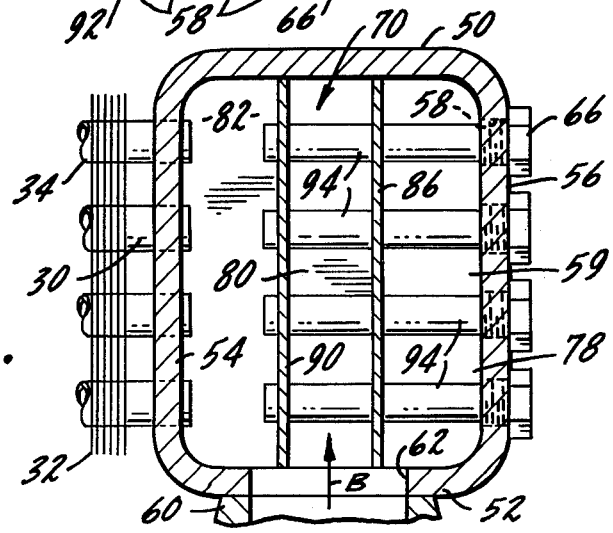
FIG. 4 is a sectional view taken along lines 4—4 in FIG. 2.

Referring to FIGS. 2, 3 and 4, an inlet flow distribution arrangement in accordance with the invention is provided within inlet header 38 and indicated generally at 70. It is the purpose of flow distribution arrangement 70 to divide the incoming fluid, which may be in the form of a mixture of vapor and liquid, which enters header 38 through inlet opening 62, proportionately among transversely spaced groups of the tubes 30. In so doing, the liquid-vapor mixture ratio entering each group of the tubes 30 is substantially the same.

In a presently preferred form of the invention, inlet flow distribution arrangement 70 includes a plurality of spaced, concentric, generally U-shaped baffles, as indicated at 72 and 74. Baffles 72 and 74 are positioned in a chamber 76 defined within inlet header 38. The open ends of baffles 72 and 74 are in contact with tube sheet 54. Baffles 72 and 74 preferably extend the entire height of chamber 76 so as to divide chamber 76 into flow channels 78, 80 and 82. Each of the flow channels 78, 80 and 82 communicates with groups of tubes in rows 42, 44, 46 and 48, substantially equidistant from and on both sides of the longitudinal center line of steam condenser 10, such that the outermost tubes 30 on both sides are in communication with channel 78, the innermost tubes 30 are in communication with channel 82 and the tubes 30 therebetween are in communication with channel 80.

As best seen in FIG. 3, baffles 72 and 74 are respectively fabricated from cooperating L-shaped plates 84 and 86, and 88 and 90. The cooperating plates are spaced from each other in the area immediately below inlet opening 62 such that a center area 92 is defined in chamber 76, in opposing relationship to opening 62, which is not divided by the baffles 72 and 74.

In operation, fluid flow, indicated by arrow B (FIG. 4), enters inlet header 38 through inlet pipe 24 and opening 62. The flow frequently takes the form of a liquid-vapor mixture. The mixture initially enters central area 92 with a vertical directional component towards the opposing wall 50. The mixture is directed generally horizontally into the respective flow channels 78, 80 and 82 in substantially equal proportions. The mixture is then directed through the channels into the inlet ends of the tubes 30 in communication therewith.

Thus, the liquid to vapor ratio of the entering fluid is substantially equal to the liquid to vapor ratio of the fluid entering each of the respective channels 78, 80 and 82 and consequently the tubes 30 in communication therewith. Accordingly, by so dividing the incoming fluid flow the potential for flooding individual tubes 30 with a disproportionate quantity of liquid is substantially eliminated.

It should be readily appreciated by those skilled in the art, that the teachings of the invention as disclosed with regard to the above discussed preferred embodiment are subject to utilization in alternative embodiments. For example, the greater the number of baffles positioned in chamber 76, the greater the number flow channels which are defined therein and the more precisely the control of the equality of the liquid to vapor ratio which enters each of the tubes 30. Further, in certain operating situations it may be desirable to have unequal numbers of tubes 30 in communication with various flow channels. This can be readily accomplished by either altering the size or spacing of the baffles or by altering the specific configuration of the baffles. It being understood that the specific number and configuration of the baffles 72 and 74 is shown for the purpose of disclosing a presently preferred embodiment and not for the purpose of indicating a limitation as to the contemplated scope of the invention.

Referring to FIGS. 3 and 4, it is necessary to provide extension plugs 94, in communication with holes 58, which extend through the baffles 72 and 74 as necessary to permit access to the tubes 30. Alternatively the header 38 and the baffles 72 and 74 may be constructed from removable plates to permit disassembly and access to the tubes 30.

Accordingly, the inlet flow distribution arrangement of the present invention provides a method and apparatus for minimizing the maldistribution of the liquid-vapor mixture entering the inlet header into the heat exchange tubes. This substantially eliminates the flooding of the tubes in communication with the ends of the inlet header and thereby maximizes available heat transfer surface of the tubes; reduces stresses in the tubes due to temperature differences between the tubes which contain a disproportionate amount of liquid and the tubes which contain a disproportionate amount of the vapor; prevents premature over cooling in the tubes in communication with the ends of the inlet header which may result in frozen conditions during cold weather; and provides such a construction which is effective, safe, inexpensive and efficient in assembly, operation and use.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved inlet flow distribution arrangement is constructed, assembled and operated, the characteristics of the new construction, and the advantageous, new and useful results obtained; the new and useful structures, devices, elements, arrangements, parts, and combinations are set forth in the appended claims.

What is claimed is:

1. In an air cooled heat exchanger of a type in which a plurality of heat exchanger tubes are arranged in a plurality of generally parallel horizontal rows, extending longitudinally between and in communication with an inlet header and an outlet header, said rows of tubes extend transversely of and at substantially vertical spaced intervals perpendicular to the direction of airflow of cooling air that passes over and around the rows of tubes to cool or condense fluid flowing through the tubes from said inlet header to said outlet header, said inlet header defining a chamber, an inlet means in communication with said chamber for directing fluid into a central portion of said chamber in a generally vertical direction, and a plurality of spaced baffle means positioned in said chamber dividing the space in said chamber into a plurality of substantially vertical flow channels in communication with said tubes for separating fluid from said inlet means substantially in proportion to the number of tubes in communication with each of said channels, said baffle means includes spaced baffle plate means which divide said chamber into a plurality of said flow channels which are each in communication with groups of said tubes substantially equadistant from the longitudinal center of said heat exchanger such that the outermost tubes on both sides are in communication with a common channel and the innermost tubes are in communication with a common channel.

2. The invention as defined in claim 1 wherein said baffle plate means include a plurality of generally U-shaped concentric baffle plates the open ends of which are in contact with a portion of said inlet header which supports the inlet ends of said tubes.

3. The invention as defined in claim 2 wherein each said baffle plates are formed from a pair of spaced L-shaped members which cooperate with one another such that said central portion of said chamber is in vertical alignment with the space between said angle plate members.

* * * * *